United States Patent [19]

Seemuth

[11] Patent Number: 4,536,190

[45] Date of Patent: Aug. 20, 1985

[54] CETANE IMPROVER COMPOSITION

[75] Inventor: Paul D. Seemuth, Baton Rouge, La.

[73] Assignee: Ethyl Corporation, Richmond, Va.

[21] Appl. No.: 596,043

[22] Filed: Apr. 2, 1984

[51] Int. Cl.[3] ..... C10L 1/08; C10L 1/22

[52] U.S. Cl. ..... 44/57

[58] Field of Search ..... 44/57; 260/466, 467

[56] References Cited

U.S. PATENT DOCUMENTS

| | | | |
|---|---|---|---|
| 2,031,497 | 2/1936 | Marvel | 44/57 |
| 2,065,588 | 12/1936 | Howes | 44/57 |
| 2,294,849 | 9/1942 | Olin et al. | 260/467 |
| 2,858,200 | 10/1958 | Broughten | 44/57 |
| 4,417,903 | 11/1983 | Hinkamp | 44/53 |
| 4,448,587 | 5/1984 | Hinkamp et al. | 44/57 |

FOREIGN PATENT DOCUMENTS

| | | | |
|---|---|---|---|
| 479969 | 2/1938 | United Kingdom | 44/57 |
| 535401 | 4/1941 | United Kingdom | 44/57 |
| 993623 | 6/1965 | United Kingdom | 44/57 |
| 1196167 | 6/1970 | United Kingdom . | |

*Primary Examiner*—Y. Harris-Smith

*Attorney, Agent, or Firm*—Donald L. Johnson; John F. Sieberth; W. G. Montgomery

[57] ABSTRACT

Compounds that are themselves effective cetane improvers in diesel fuel but are considered too explosion sensitive for safe handling can be rendered relatively nonsensitive by blending with nitric acid esters of bicyclic or tricyclic alcohols containing a four-membered or five-membered ring and the resulting blend is an effective cetane improver. An example is a 50-50 blend of 2-methyl-2-nitropropyl nitrate, a shock-sensitive compound, with 5,6-cyclopenteno-2-norbornyl nitrate to give a relatively insensitive, but very effective cetane improver.

11 Claims, No Drawings

CETANE IMPROVER COMPOSITION

BACKGROUND OF THE INVENTION

Diesel engines operate by compression ignition. They have compression ratios in the range of 14:1 to 17:1 or higher and for that reason obtain more useful work from a given amount of fuel compared to a spark-ignited engine. Historically, diesel engines have been operated on a petroleum-derived liquid hydrocarbon fuel boiling in the range of about 300°-750° F. Recently, because of dwindling petroleum reserves, alcohol and alcohol-hydrocarbon blends have been studied for use as diesel fuel.

One major factor in diesel fuel quality is cetane number. Cetane number is related to ignition delay after the fuel is injected into the combustion chamber. If ignition delay is too long, the amount of fuel in the chamber increases and upon ignition results in a rough running engine and increased smoke. A short ignition delay results in smooth engine operation and decreases smoke. Commercial petroleum diesel fuels generally have a cetane number of about 40-55. Alcohols have a much lower cetane value and require the addition of a cetane improver for successful engine operation.

Through the years, many types of additives have been prepared to raise the cetane number of diesel fuel. These include peroxides, nitrites, nitrates, nitrocarbamates, and the like. Alkyl nitrates such as amyl nitrate, hexyl nitrate and mixed octyl nitrates have been used commercially with good results. Likewise, certain cyclohexyl nitrates and alkoxyalkyl nitrates have been suggested as cetane improvers for diesel fuel (Olin et al., U.S. Pat. No. 2,294,849).

Unfortunately some compounds that are very effective cetane improvers are also fairly sensitive explosives. Because of this they have not found commercial acceptance. Attempts have been made to desensitize some of these explosive compounds by blending with inert solvents. However, such blends are much less effective than the original compound and would require shipping and storing large amounts of cetane improver additive to provide the required cetane boost.

U.S. Ser. No. 479,508, entitled "Desensitized Cetane Improvers", filed Mar. 28, 1983, discloses that normally explosion sensitive cetane improvers can be desensitized by blending with $C_5$-$C_{12}$ alkyl nitrates to provide a blend of cetane improvers that is both safe and effective.

SUMMARY OF THE INVENTION

It has now been discovered that normally explosion sensitive cetane improvers can be desensitized by blending with nitric acid esters of bicyclic or tricyclic alcohols containing four-membered or five-membered rings to provide a blend of cetane improvers that is both a safe and effective cetane additive.

DESCRIPTION OF THE PREFERRED EMBODIMENT

A preferred embodiment of the invention is a desensitized cetane improver for use in diesel fuel, said cetane improver comprising a mixture of (a) at least one compound having a 50% explosion Drop Weight Rating of less than 20 Kg centimeters (cms) as measured by ASTM Method D-2540 and being capable of giving a greater cetane increase than an equal amount of any $C_5$ to $C_{12}$ alkyl nitrate, and (b) a nitric acid ester of a bicyclic or tricyclic alcohol containing a four-membered or a five-membered ring in an amount sufficient to increase the ASTM D-2540 rating of the mixture to a value of at least 40 Kg centimeters (cms).

Explosive sensitivity is measured using the ASTM D-2540. This method is substantially the same as the Olin Matheson Drop Weight Test. It is routinely used to rate explosion sensitivity of liquid rocket mono-propellants. In this test, the test sample is placed in a small cavity formed by a steel cup. In the cup is placed an elastic ring and a steel diaphram on top of the elastic ring. A piston rests on the diaphram. The piston has a vent hole which is blocked by the steel diaphram. A weight is dropped on the piston. Explosion is indicated by puncture of the diaphram and a loud report. The sensitivity is the energy required to cause an explosion fifty percent of the time. This energy is the product of the drop weight and height of drop and is expressed as Kilogram centimeters (Kg cms). The lower this value is, the more explosion sensitive the test additive. A typical value for sensitive compounds such as nitroglycerin, ethyl nitrate and diethylene glycol dinitrate is 2 Kg-cms. Normal propyl nitrate rates about 15.5 Kg-cm.

Component (a) of the mixture will have a 50% explosion ASTM D-2540 rating of less than 20 Kg cm and also have a cetane improving effectiveness which is greater than that of an alkyl nitrate containing 5-12 carbon atoms. Thus, whether a compound qualifies as a component (a) additive is readily determined by conducting an ASTM D-2540 Drop Weight Test and measuring its cetane improving effectiveness on a weight basis using a standard cetane engine compared to amyl nitrate, hexyl nitrates, heptyl nitrates, octyl nitrates, decyl nitrates or dodecyl nitrates.

Representative explosion sensitive compounds include the $C_{1-3}$ alkyl nitrates such as methyl nitrate, ethyl nitrate, n-propyl nitrate and isopropyl nitrate.

Organic polynitrates containing about 2-6 carbon atoms and 2-6 nitrate groups are useful such as glycol dinitrate, nitroglycerine, mannitol tetranitrate, trimethylolpropane trinitrate, pentaerythritol tetranitrate, propylene glycol dinitrate, 1,4 butanediol dinitrate, and the like.

Many ether nitrates are sensitive explosives such as diethylene-glycol dinitrate, triethyleneglycol, dinitrate, tetraethyleneglycol dinitrate, tetrahydro-3-furanol nitrate, 2-ethoxyethyl nitrate, 2-methoxyethyl nitrate, tetrahydro-3,4-furandiol dinitrate and the like.

Of the foregoing, the more preferred ether nitrates are those having the formula $$R_1\text{-}(OR_2)_n\text{-}ONO_2$$

or $$O_2N\text{-}(OR_3)_m\text{-}ONO_2$$

wherein $R_1$ is a $C_{1-4}$ alkyl, $R_2$ and $R_3$ are $C_{2-4}$ divalent aliphatic hydrocarbon radicals and n is an integer from 1 to 4 and m is an integer from 2 to 4.

Organic nitro-nitrate compounds containing about 3-6 carbon atoms are likewise very effective cetane improving compounds that are also sensitive to explosion. These include compounds having the formula

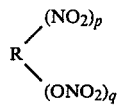

in which R is an aliphatic hydrocarbon group containing 3–6 carbon atoms and p and q are integers independently selected from 1 and 2.

Representative examples of these compounds are 2,2-dinitro-propanol nitrate, 2-methyl-2-nitropropyl nitrate, 2-ethyl-2-nitro-1,3-propanediol dinitrate, 2-methyl-2-nitro-1,3-propanediol dinitrate, 2,2-dinitro-1,6-hexanediol dinitrate, 2,2-dinitrobutanol nitrate and the like.

Component (b) in the mixture is a nitric acid ester of a bicyclic or tricyclic alcohol containing a four-membered or five-membered ring such as norbornyl nitrate, isobornyl nitrate, pinene nitrate, 5,6-cyclopenteno-2-norbornyl nitrate, 5,6-cyclopenteno-3-norbornyl nitrate and 5,6-cyclopentano-2-norbornyl nitrate. Most preferably component (b) is 5,6-cyclopenteno-2-norbornyl nitrate. These compounds and methods for their preparation are disclosed in British 1,196,167 incorporated herein by reference.

The amount of component (b) in the blend should be an amount that reduces the explosion sensitivity of the mixture to an ASTM D-2540 rating above about 20 Kg cm. More preferably, the amount of component (b) will be sufficient to increase the rating above about 40. Depending upon the degree of de-sensitizing required, the amount of component (b) can range from 10–90 weight percent of the mixture. Generally, the amount of (b) will be 25–75 weight percent. Excellent results have been achieved with 50—50 mixtures.

Representative examples of blends are given in the following table:

| Component A | Component B |
|---|---|
| 30% ethylene glycol dinitrate | 70% 5,6-cyclopenteno-2-norbornyl nitrate |
| 50% diethylene glycol dinitrate | 50% 5,6-cyclopenteno-2-norbornyl nitrate |
| 10% 2-methoxyethyl nitrate | 90% 5,6-cyclopenteno-2-norbornyl nitrate |
| 40% 2-ethoxyethyl nitrate | 60% 5,6-cyclopenteno-2-norbornyl nitrate |
| 60% 2-butoxyethyl nitrate | 40% 5,6-cyclopenteno-2-norbornyl nitrate |
| 10% nitroglycerine | 90% 5,6-cyclopenteno-2-norbornyl nitrate |
| 15% trimethylol propane trinitrate | 85% 5,6-cyclopenteno-2-norbornyl nitrate |
| 50% tetrahydro-3-furanol nitrate | 50% 5,6-cyclopenteno-2-norbornyl nitrate |
| 30% 2-nitro-2-methylpropyl nitrate | 70% 5,6-cyclopenteno-2-norbornyl nitrate |
| 35% 2,2-dinitrobutyl nitrate | 65% 5,6-cyclopenteno-2-norbornyl nitrate |
| 30% ethylene glycol dinitrate | 70% 5,6-cyclopenteno-3-norbornyl nitrate |
| 50% diethylene glycol dinitrate | 50% 5,6-cyclopenteno-3-norbornyl nitrate |
| 10% 2-methoxyethyl nitrate | 90% 5,6-cyclopenteno-3-norbornyl nitrate |
| 40% 2-ethoxyethyl nitrate | 60% 5,6-cyclopenteno-3-norbornyl nitrate |
| 60% 2-butoxyethyl nitrate | 40% 5,6-cyclopenteno-3-norbornyl nitrate |
| 10% nitroglycerine | 90% 5,6-cyclopenteno-3-norbornyl nitrate |
| 15% trimethylol propane trinitrate | 85% 5,6-cyclopenteno-3-norbornyl nitrate |
| 50% tetrahydro-3-furanol nitrate | 50% 5,6-cyclopenteno-3-norbornyl nitrate |
| 30% 2-nitro-2-methylpropyl nitrate | 70% 5,6-cyclopenteno-3-norbornyl nitrate |
| 35% 2,2-dinitrobutyl nitrate | 65% 5,6-cyclopenteno-3-norbornyl nitrate |
| 30% ethylene glycol dinitrate | 70% norbornyl nitrate |
| 50% diethylene glycol dinitrate | 50% norbornyl nitrate |
| 10% 2-methoxyethyl nitrate | 90% norbornyl nitrate |
| 40% 2-ethoxyethyl nitrate | 60% norbornyl nitrate |
| 60% 2-butoxyethyl nitrate | 40% norbornyl nitrate |
| 10% nitroglycerine | 90% norbornyl nitrate |
| 15% trimethylol propane trinitrate | 85% norbornyl nitrate |
| 50% tetrahydro-3-furanol nitrate | 50% norbornyl nitrate |
| 30% 2-nitro-2-methylpropyl nitrate | 70% norbornyl nitrate |
| 35% 2,2-dinitrobutyl nitrate | 65% norbornyl nitrate |
| 30% ethylene glycol dinitrate | 70% pinene nitrate |
| 50% diethylene glycol dinitrate | 50% pinene nitrate |
| 10% 2-methoxyethyl nitrate | 90% pinene nitrate |
| 40% 2-ethoxyethyl nitrate | 60% pinene nitrate |
| 60% 2-butoxyethyl nitrate | 40% pinene nitrate |
| 10% nitroglycerine | 90% pinene nitrate |
| 15% trimethylol propane trinitrate | 85% pinene nitrate |
| 50% tetrahydro-3-furanol nitrate | 50% pinene nitrate |
| 30% 2-nitro-2-methylpropyl nitrate | 70% pinene nitrate |
| 35% 2,2-dinitrobutyl nitrate | 65% pinene nitrate |

It is indeed surprising that the addition of a compound which is itself an organic nitrate as well as an effective cetane improver to an otherwise explosive nitrate would have such a substantial effect on decreasing sensitivity.

ASTM D-2540 Drop Weight Tests were conducted to measure the de-sensitizing effect of the added organic nitrate. In these tests, an otherwise very sensitive compound, 2-nitro-2-methylpropyl nitrate, was blended with 5,6-cyclopenteno-2-norbornyl nitrate to decrease sensitivity. This compound alone is more effective as a cetane improver than any $C_{5-12}$ alkyl nitrate but is quite prone to explode in the Drop Weight Test. The Drop Weight results are given in the following table.

| Additive | Drop Weight Rating |
|---|---|
| 1. 2-nitro-2-methylpropyl nitrate | 10 Kg cm |
| 2. 2-nitro-2-methylpropyl nitrate + 25 wt. % 5,6-cyclopenteno-2-norbornylnitrate | 24 Kg cm |
| 3. 2-nitro-2-methylpropyl nitrate + 50 wt. % 5,6-cyclopenteno-2-norbornylnitrate | 57 Kg cm |
| 4. 2-nitro-2-methylpropyl nitrate + 50 wt. % 5,6-cyclopenteno-2-norbornylnitrate | 120 Kg cm |

These results show that blending the explosion sensitive organic nitrates with a component (b) organic nitrate results in a substantially de-sensitized composition. The de-sensitizing effect provided by the invention is not necessarily applicable to thermal stability so, as with any organic nitrate, the mixtures should not be heated.

I claim:

1. A desensitized cetane improver for use in diesel fuel, said cetane improver comprising a mixture of (a) at least one compound having a 50% explosion Drop Weight Rating of less than 20 Kg centimeters as measured by ASTM Method D-2540 and being capable of giving a greater cetane increase than an equal weight of any $C_5$ to $C_{12}$ alkyl nitrate and (b) a nitric acid ester of a bicyclic or tricyclic alcohol containing a four-membered or five-membered ring in an amount sufficient to increase the ASTM D-2540 rating of the mixture to a value of at least 40 Kg cms.

2. A cetane improver of claim 1 wherein component (b) is selected from the group consisting of norbornyl nitrate, isobornyl nitrate, pinene nitrate, 5,6-cyclopenteno-2-norbornyl nitrate, 5,6-cyclopenteno-3-norbornyl nitrate and 5,6-cyclopentano-2-norbornyl nitrate and mixtures thereof.

3. A cetane improver of claim 1 wherein component (b) is 5,6-cyclopenteno-2-norbornyl nitrate.

4. A cetane improver of claim 2 wherein said compound having a 50% explosion ASTM D-2540 rating of less than 20 Kg centimeters is selected from the group consisting of $C_1$–$C_3$ alkyl nitrates, $C_2$–$C_6$ organic polynitrates, $C_3$–$C_8$ ether nitrates, $C_3$–$C_6$ organic nitro-nitrates, and mixtures thereof.

5. A cetane improver of claim 4 wherein said compound is an ether nitrate having the formula:

$$R_1\text{-}(OR_2)_n ONO_2$$

or $$O_2N\text{-}(OR_3)_m ONO_2$$

wherein $R_1$ is a $C_1$–$C_4$ alkyl and $R_2$ and $R_3$ are $C_2$–$C_4$ divalent aliphatic hydrocarbon groups, n is an integer from 1 to 4, and m is an integer from 2–4.

6. A cetane improver of claim 5 wherein said compound is a polyethylene glycol dinitrate containing 2–4 ethylene units.

7. A cetane improver of claim 4 wherein said compound is a $C_3$–$C_6$ organic nitro-nitrate having the formula:

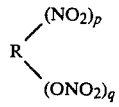

wherein R is an aliphatic hydrocarbon group containing 3–6 carbon atoms and p and q are integers independently selected from 1 and 2.

8. A cetane improver of claim 7 wherein said compound is 2-methyl-2-nitro-propyl nitrate.

9. A de-sensitized cetane improver consisting essentially of (a) about 25–75 weight percent of an organic nitro-nitrate containing 3–6 carbon atoms having an ASTM Method D-2540 Drop Weight Rating below about 20 Kg centimeters, and (b) about 75–25 weight percent of a nitric acid ester of a bicyclic or tricyclic alcohol containing a four-membered or five-membered ring.

10. A de-sensitized cetane improver of claim 9 wherein said organic nitro-nitrate is 2-methyl-2-nitro-propyl nitrate.

11. A de-sensitized cetane improver of claim 9 wherein said component (b) is 5,6-cyclopenteno-2-norbornyl nitrate.

* * * * *